US007000689B2

(12) United States Patent
Finch et al.

(10) Patent No.: US 7,000,689 B2
(45) Date of Patent: Feb. 21, 2006

(54) FLUID CONNECTORS FOR HEAT EXCHANGERS

(75) Inventors: Derek I Finch, Goldsboro, NC (US); Gary A Crawford, Goldsboro, NC (US); Neil E Jarman, Snow Hill, NC (US)

(73) Assignee: APV North America, Inc., Schiller Park, IL (US)

( * ) Notice: Subject to any disclaimer, the term of this patent is extended or adjusted under 35 U.S.C. 154(b) by 252 days.

(21) Appl. No.: 10/092,382

(22) Filed: Mar. 5, 2002

(65) Prior Publication Data

US 2004/0211550 A1 Oct. 28, 2004

(51) Int. Cl.
*F28F 9/04* (2006.01)

(52) U.S. Cl. ..... 165/167; 165/178

(58) Field of Classification Search ..... 165/167, 165/178, 153, 144, 76; 285/133.11, 133.21, 285/133.6; 29/890.48; 60/3.7
See application file for complete search history.

(56) References Cited

U.S. PATENT DOCUMENTS 4,094,358 A * 6/1978 Neveux ..... 165/154
4,614,231 A * 9/1986 Proctor et al. ..... 165/153
5,325,915 A * 7/1994 Fouts et al. ..... 165/78
5,355,947 A * 10/1994 Rasso et al. ..... 165/176
5,358,034 A * 10/1994 Nishishita et al. ..... 165/155
5,390,732 A * 2/1995 Bathla ..... 165/153
5,413,169 A * 5/1995 Frazier et al. ..... 165/153
5,561,981 A * 10/1996 Quisenberry et al. ..... 62/3.7
5,590,707 A * 1/1997 Mauterer ..... 165/145
5,988,270 A * 11/1999 Chevallier ..... 165/178

FOREIGN PATENT DOCUMENTS

JP 02225954 A * 9/1990
JP 09061084 A * 3/1997

* cited by examiner

*Primary Examiner*—Tho Duong
(74) *Attorney, Agent, or Firm*—Foley & Lardner LLP

(57) ABSTRACT

A fluid connector for providing an inlet/outlet connection to a connecting grid of a heat exchanger is disclosed in which the connector has a tubular body formed with an integral outwardly directed flange by means of which a fluid tight connection to the connecting grid can be achieved. The flange may be sealed relative to an aperture in a plate of the connecting grid. Alternatively, the aperture may be provided with a structural ring and the flange sealed relative to the structural ring for adapting the aperture to the size and/or position of the flange. A set of structural rings may be provided for use of the connecting grid with different connectors. The structural ring may allow the connector to be detached without disassembling the connecting grid. The aperture may be closed by a blanking disc.

22 Claims, 19 Drawing Sheets

FLUID CONNECTORS FOR HEAT EXCHANGERS

BACKGROUND OF THE INVENTION

This invention concerns improvements to fluid connectors for connecting grids of heat exchangers and improvements to methods of making fluid connectors. In particular, but not exclusively, the invention relates to bosses for a connecting grid used within a plate heat exchanger.

It is known to use bosses for providing a fluid connection to sections of a plate pack of a heat exchanger separated by a connecting grid. These known bosses have a high manufacturing cost. A prior art boss is shown in FIG. 19 of the drawings.

The boss (1900) is usually manufactured by sand or investment casting and subsequently machined to quite high tolerances to ensure that it will fit in a connecting grid. Where it is important to ensure a sanitary surface, i.e. where milk or other food product is to be passed through the heat exchanger, grinding and polishing of the boss is necessary.

The boss (1900) is provided with an opening (1905) for connecting to a heat exchanger and an external opening (1904) having a fitting (1902) for connecting to the user's pipework. The fitting (1902) can be welded onto a branch (1903) of the boss (1900). A seal ring (port ring) or elastomeric gasket is used between the opening (1905) of the boss (1900) and a heat transfer plate of the heat exchanger to seal the boss (1900) against the heat transfer plates. The port ring sits within a groove machined into the boss (1900).

Assembly of this boss (1900) to a connecting grid is achieved by locating the boss (1900) over a dowel protruding from the connecting grid and securing the boss (1900) by a short hex head screw.

SUMMARY OF THE INVENTION

It is an object of the present invention to provide a fluid connector that mitigates or overcomes at least some of the disadvantages of the known bosses as described above.

According to a first aspect of the invention, there is provided a heat exchanger comprising a plurality of heat transfer plates stacked together such that a plurality of fluid channels are provided therebetween, at least one connecting grid separating the plurality of heat transfer plates into groups of heat transfer plates, and at least one fluid connector in fluid communication with a fluid channel via the connecting grid, the connector comprising a tubular body having an outwardly directed flange formed integrally from a wall of the tubular body to sealingly enable or, disable flow into channels between the plates.

By this invention, the flange of the fluid connector can be produced integrally with the fluid connector by deforming the wall of the tubular body using existing manufacturing techniques enabling the fluid connector to be made using standard components at a lower cost than the previously known bosses. For example, the tubular body may be formed from thin gauge tube or pipe having a nominal diameter to wall thickness ratio within the range 20 to 70.

The fluid tight connection may be provided between the flange and a plate of the connecting grid. Alternatively, the fluid tight connection may be provided between the flange and an insert such as a structural ring received in an opening in the plate. In this way, the structural ring can adapt the connecting grid to accommodate a difference in diameter between the tubular body and the opening in the plate.

The structural ring may be arranged such that the fluid connector can be detachably connected to the heat exchanger without disassembling the connecting grid. For example, the structural ring may project from the opening on the side of the plate facing the flange.

The structural ring may provide an aperture coaxial with the opening in the plate of the connecting grid. Alternatively, the structural ring may provide an aperture eccentric to the opening in the plate of the connecting grid. In this way, the structural ring can adapt the connecting grid to accommodate a difference in the position of the tubular body and the opening in the plate. Moreover, all the components in contact with the fluid flowing through the fluid connector may be made of a suitable material without requiring the connecting grid to be made of the same material. This can result in a substantial reduction in manufacturing costs A set of interchangeable structural rings may be provided with apertures of different size and/or at different positions for selection and fitment of the appropriate structural ring for a given fluid connector.

Preferably, means is provided to assist correct rotational or angular alignment of the structural ring during assembly. For example, the alignment means may be provided by co-operating formations on the structural ring and plate. Alternatively or additionally, alignment marks may be provided on the structural ring and the plate to assist visual alignment of the structural ring.

The fluid tight connection between the flange of the fluid connector and the structural ring may include a separate seal located therebetween. For example, an annular sealing ring may be received in a groove in one of the flange and structural ring. Alternatively, the structural ring may be made of elastomeric material whereby the fluid tight connection to the flange of the connector is provided without a separate seal.

Preferably, the fluid connector provides an inlet/outlet connection externally of the heat exchanger. The inlet/outlet connection may be employed to connect the heat exchanger to a measuring instrument, sample point, drain, vent or any other purpose.

In one arrangement, the connecting grid comprises a pair of plates and the fluid connector is connected to one of the plates. For example, the fluid connector may be an elbow connector or similar providing an inlet/outlet connection to one side of the connecting grid.

In another arrangement, a pair of fluid connectors is provided each connected to a respective one of the plates of the connecting grid. In this arrangement, the fluid connectors may overlap in an axial direction to reduce the space between the plates of the connecting grid.

In yet another arrangement, the fluid connector is connected to both plates of the connecting grid. For example, the fluid connector may be a T-connector providing an inlet/outlet connection to both sides of the connecting grid. In this arrangement, both sides of the connecting grid may be open. Alternatively, one side of the connecting grid may be open and the other side closed. For example, the plate on the closed side may be formed without an opening. Alternatively, the opening may be closed by an adjacent heat transfer plate or by an insert such as a blanking disc received in the opening.

According to a second aspect of the present invention there is provided a method of forming a fluid tight connection between a connecting grid of a heat exchanger and a fluid connector comprising the steps of forming a fluid connector by providing a tubular body and deforming an end region of the tubular body to form an outwardly directed flange, and connecting the fluid connector to the connecting grid so that the tubular body is in fluid communication with at least one fluid channel of the heat exchanger via a fluid tight connection to the connecting grid According to a third aspect of the present invention, there is provided a connecting grid for a heat exchanger, the connecting grid having an opening in a plate, and an insert received in the opening for adapting the connecting grid to close the opening or to connect a fluid connector to the heat exchanger.

The insert may be a blanking disc to close the opening. Alternatively, the insert may be a structural ring to connect the fluid connector to the heat exchanger. A set of interchangeable structural rings may be provided for mounting in the opening with each ring having an opening of different size and/or at a different position for converting the opening to the size and/or position of the fluid connector.

According to a fourth aspect of the present invention there is provided a set of inserts for use with a connecting grid, each insert having an aperture therein and being interchangeable for selective fitment in an opening in a plate of the connecting grid, wherein the apertures are of different size and/or positions for adapting the connecting grid for connection to a fluid connector.

According to a fifth aspect of the present invention there is provided an adapter for detachably attaching a fluid connector to a connecting grid, the adapter comprising an insert adapted to be received in an opening in a plate of the connecting grid whereby a fluid connector can be detachably connected to the connecting grid via the insert.

Other features, benefits and advantages of the invention will be apparent from the description hereinafter of exemplary embodiments with reference to the accompanying drawings.

DETAILED DESCRIPTION OF THE EXEMPLARY EMBODIMENTS

Figure 1:
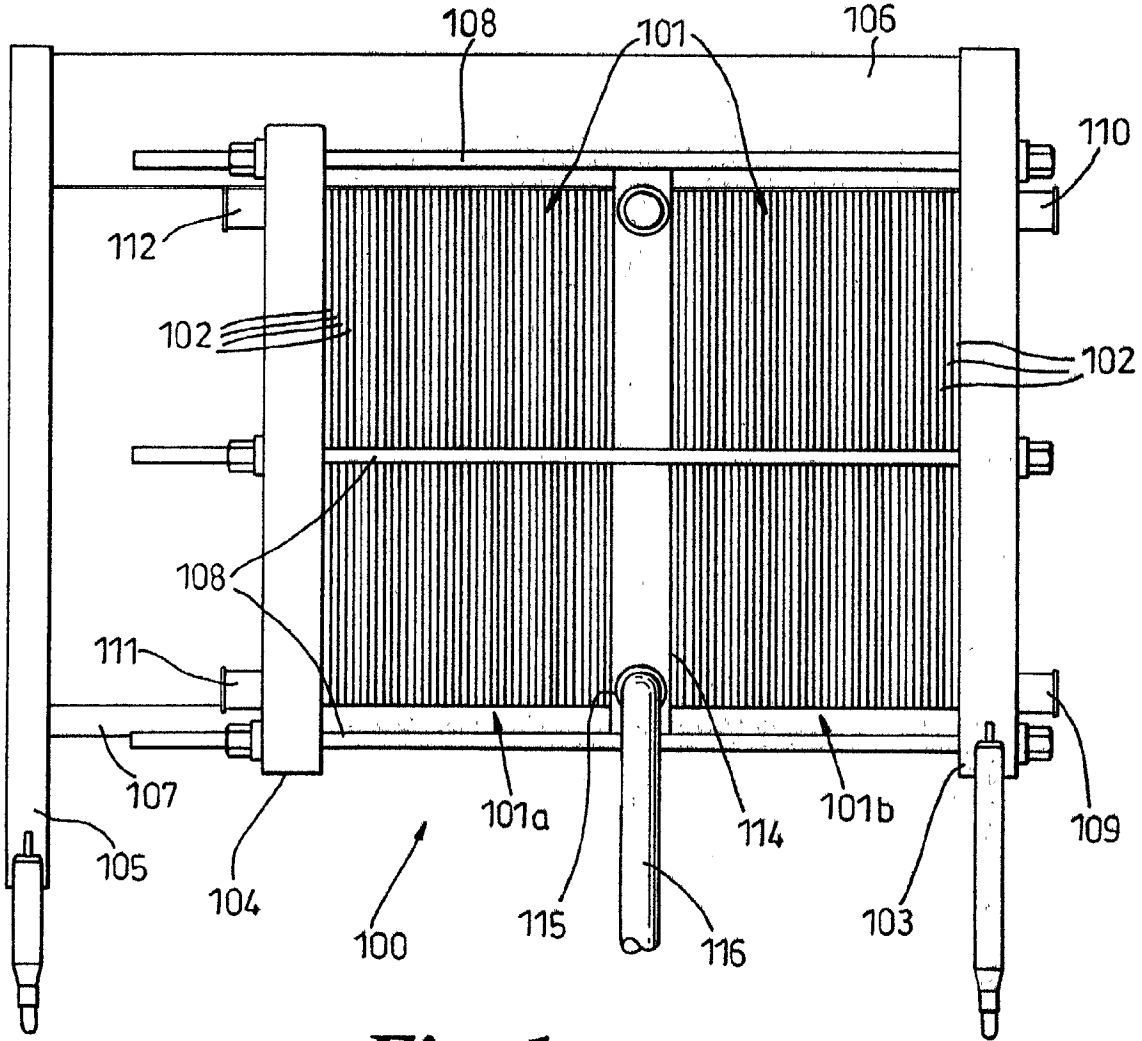
FIG. 1 shows a heat exchanger embodying the invention.

Shown in FIG. 1 is a heat exchanger (100). The heat exchanger (100) has a plate pack (101) comprising a number of heat transfer plates (102) of substantially rectangular shape sandwiched between a fixed head (103) and a movable follower (104) such that a plurality of fluid channels are provided therebetween. Six tie bars (108) (in the drawing only three are visible) compress the heat transfer plates (102) of the plate pack (101) between the fixed head (103) and the movable follower (104).

The plate pack (101) is supported on a frame consisting of the fixed head (103), fixed end support (105), top carrying bar (106) and bottom bar (107).

The fixed head (103) and movable follower (104) comprise of solid blocks of metal having pressed in place non-removable connections (109–112) extending therethrough that provide inlets/outlets to the plate pack (101). Each connection (109–112) is formed in place on the fixed head (103) or movable follower (104) and consists of a straight tubular body having no partitions or branches extending therefrom. Due to the fact that the connections (109–112) are pressed in place they can only be destructively removed from the fixed head (103) or moveable follower (104). Each heat transfer plate (102) has one or more ports (not shown) for connecting the plate (102) in fluid communication to other devices including other heat transfer plates (102).

The plate pack (101) is divided into two plate sections **(101*a* and 101*b*) by a connecting grid (114). Each section (101*a* and 101*b*) comprises any number of heat transfer plates (102) and any two sections (101*a* and 101*b*) do not necessarily have the same number of heat transfer plates (102)**.

Bosses (115) positioned in the connecting grid (114) provide fluid connections to one or both plate sections **(101*a* and 101*b*). Fluid can therefore be transferred from an inlet (109–112) through a plate section (101*a* and 101*b*) to the connecting grid (114)** or vice-versa.

The sections **(101*a* and 101*b*) may be simply joined together so that fluid flows from the end of one section to the beginning of the other, the connecting grid (114) allowing fluid to be extracted i.e. for testing. Alternatively, the connecting grid (114) divides the plate pack (101) into the different sections (111*a* and 10*b*)** for different duties.

Typically four bosses (115) are used in each connecting grid (114). Each boss (115) may be provided with none, one or two fitting(s) (116) for the user's application. For example to connect to pipework, install a measuring instrument, provide a sample point, drain or a vent.

Figure 2:
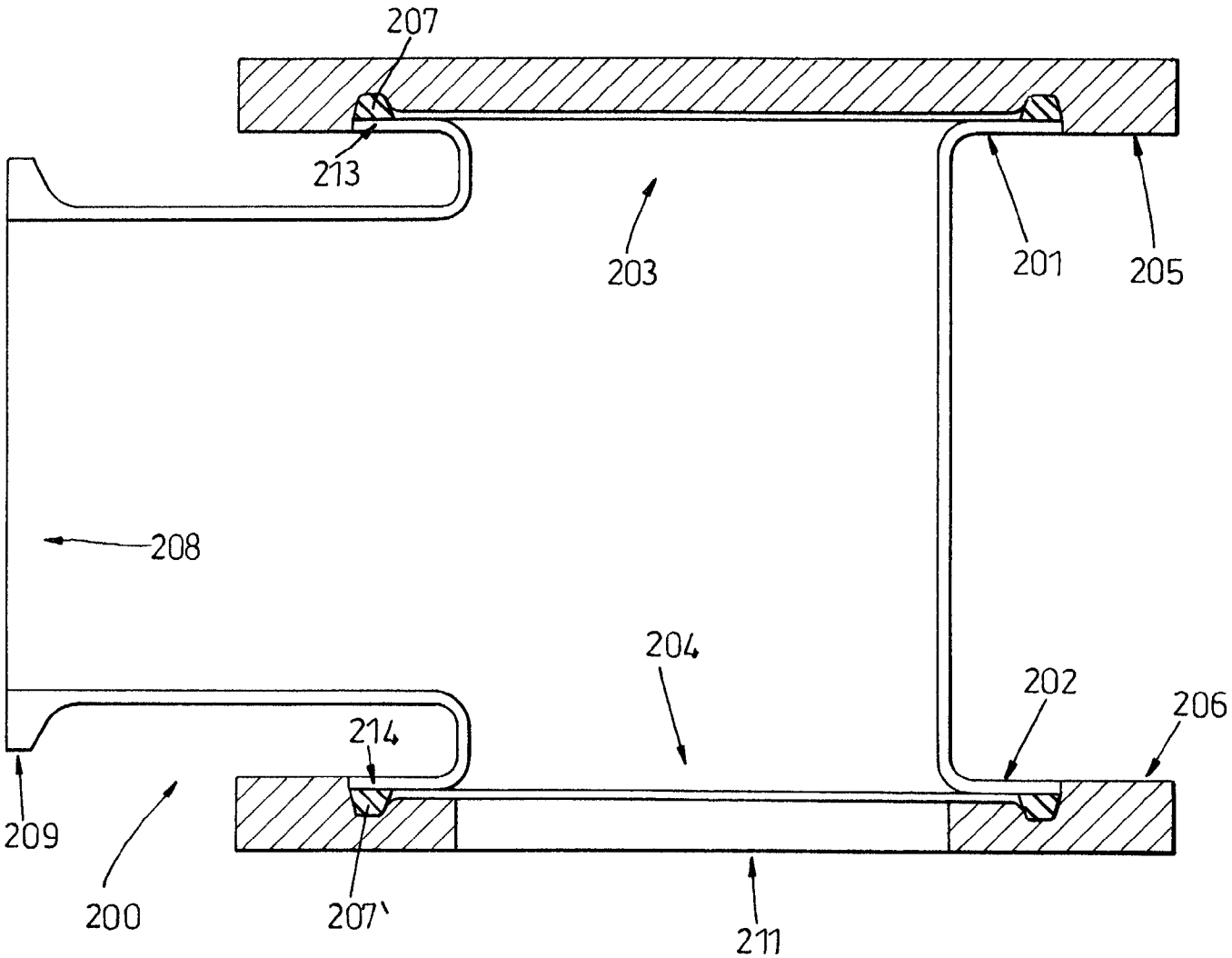
FIG. 2 shows a cross-section of a boss according to a first embodiment of the invention.

Referring now to FIG. 2, the connecting grid is formed of two plates (205, 206) separated and held apart by an open or closed mechanical structure (not shown). The connecting grid is usually manufactured to ensure positional accuracy when assembling the bosses into the grid.

Each plate (205, 206) of the connecting grid may or may not have a substantially circular aperture or hole (211) manufactured therein depending on the user's requirements. In FIG. 2, grid plate (206) is manufactured with an aperture (211) and grid plate (205) is manufactured without an aperture.

A cross-section of a tee-shaped boss (200) according to a first embodiment of this invention is also shown in FIG. 2. The boss (200) is formed of a tubular shaped body having openings (203 and 204) for connection to plates (205 and 206) of the connecting grid between which the boss (200) is held. The plate (206) provides fluid communication between the opening (204) of the boss (200) and the heat exchanger on one side of the connecting grid via aperture (211). The plate (205) closes the opening (203) of the boss (200) on the other side of the connecting grid. A third external opening (208) is provided with a fitting (209) for connecting the boss (200) to devices for the user's application.

The regions of the tubular shaped body at the openings (203,204) of the boss (200) increase in diameter to produce flanges (201 and 202) at the openings (203 and 204). The flanges (201, 202) provide outwardly directed annular faces for abutting plates (205,206) of the connecting grid between which the boss (200) is held. A groove (213, 214) is provided in the plates (205, 206) of the connecting grid for accepting an annular seal (207, 207'). The seal (207, 207') provides a fluid tight seal between the boss (200) and plates (205, 206). The groove locates and provides additional support for the seal.

The boss (200) is manufactured from thin gauge tube, tee with a branch, bend or similar component. The tube can be made of stainless steel, titanium or other suitable material and typically has a diameter to wall thickness within the range 20 to 70. Preferably, the tube is of a similar diameter to the port diameter of the heat transfer plates. However, a tube having smaller or larger diameters may be accommodated.

The flanges (201, 202) are produced in a tool away from the connecting grid either simultaneously or individually. The bosses are then subsequently assembled into the connecting grid. Such remote manufacture has at least three advantages:—

1) Grid assemblies can be assembled and later reconfigured as necessary.
2) The bosses may be finished with a polishing operation without the encumbrance of an attached connecting grid.
3) Lower cost of manufacture since a less complex work area, tool or jig design is required.

Such a method of manufacture of the boss and installation can be accomplished using manufacturing processes and standard and custom components already available. Furthermore, bosses manufactured according to this method can be removed from the connecting grid without being destroyed and therefore are reusable.

As will be appreciated one or both openings of the boss can either be closed off to stop fluid flow or left open to allow fluid flow to the heat transfer plates. FIGS. 3–6 show a variety of different ways in which the openings can be closed/left open.

Figure 3:
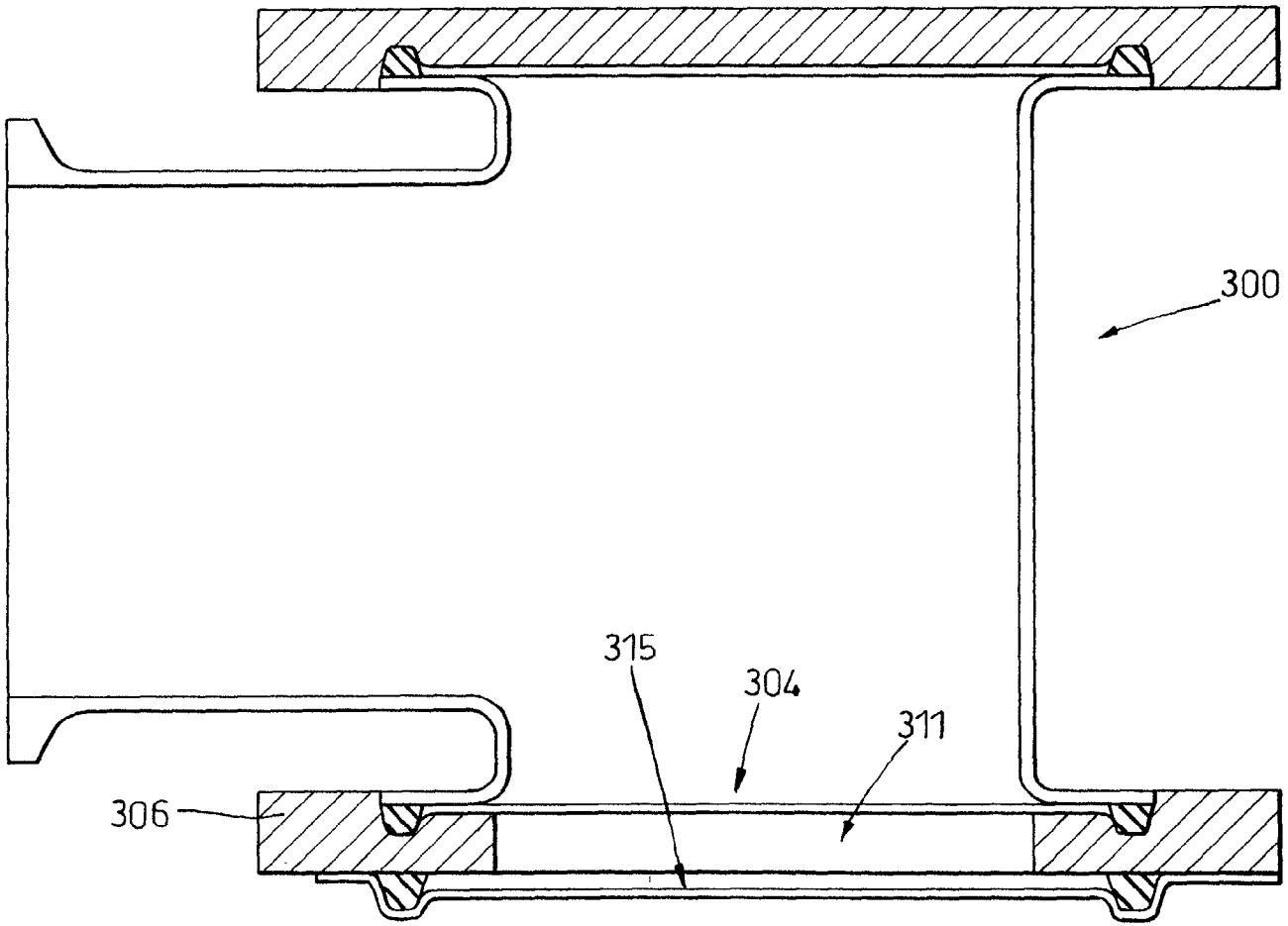
FIG. 3 shows a cross-section of a boss according to the first embodiment connected to a heat exchanger in one arrangement.

Shown in FIG. 3 is a boss (300) according to the first embodiment of the invention wherein the aperture (311) in plate (306) of the connecting grid is blocked off by the adjacent heat transfer plate (315) which has an unpierced port. Therefore, the boss opening (304) is closed off without being modified from the boss (200) as described with reference to FIG. 2. Such a method of closing the opening (304) to the boss (300) can be used where the unpierced port of the heat transfer plate (315) is strong enough to support the fluid pressure within the heat exchanger.

Figure 4:
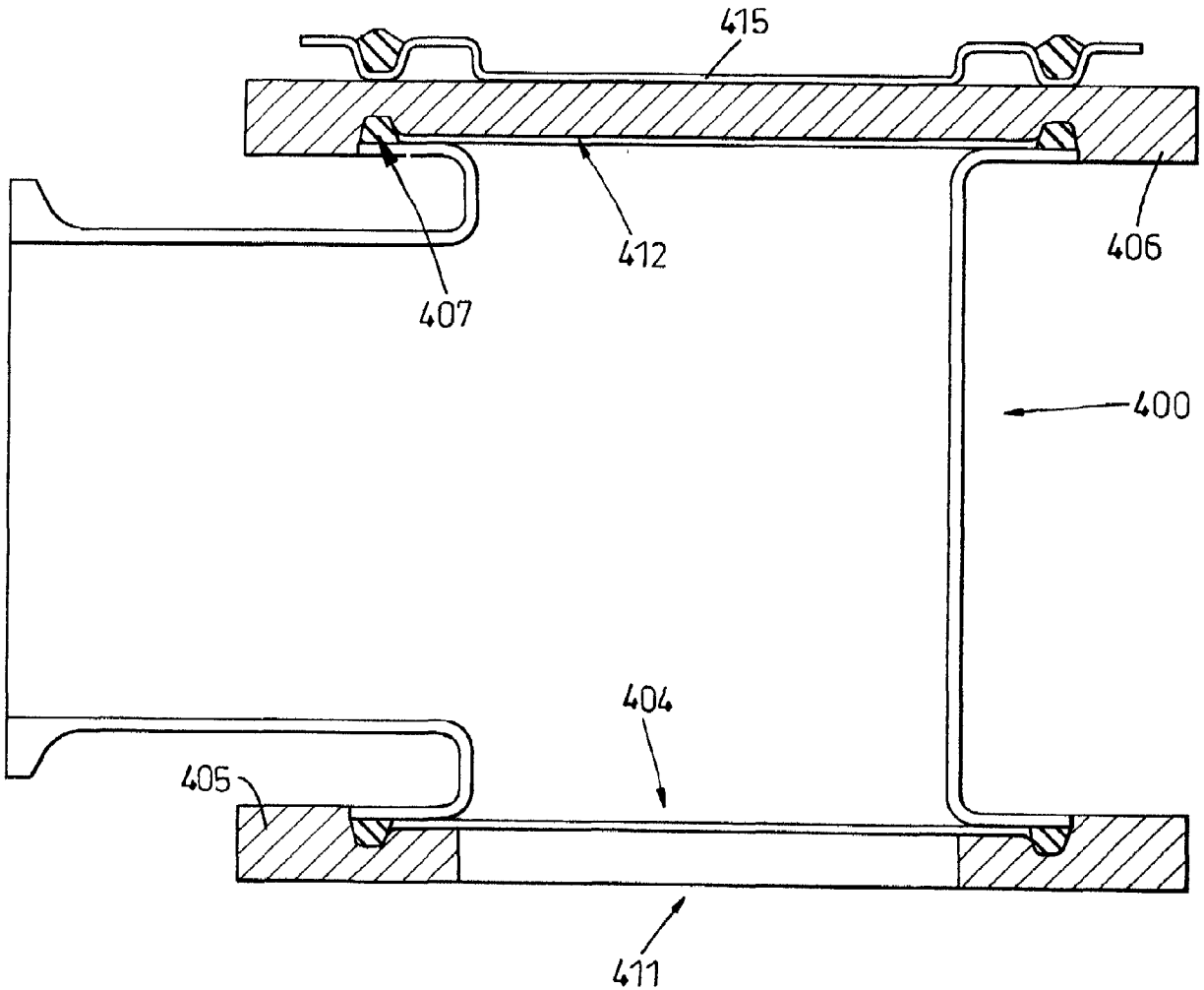
FIG. 4 shows a cross-section of a boss according to the first embodiment connected to a heat exchanger in another arrangement.

Shown in FIG. 4 is an arrangement for closing off the opening (404) to the boss (400) wherein the unpierced port of the heat transfer plate (415) needs supporting. In this arrangement the plate (406) of the connecting grid is manufactured without an aperture (412).

Figure 5:
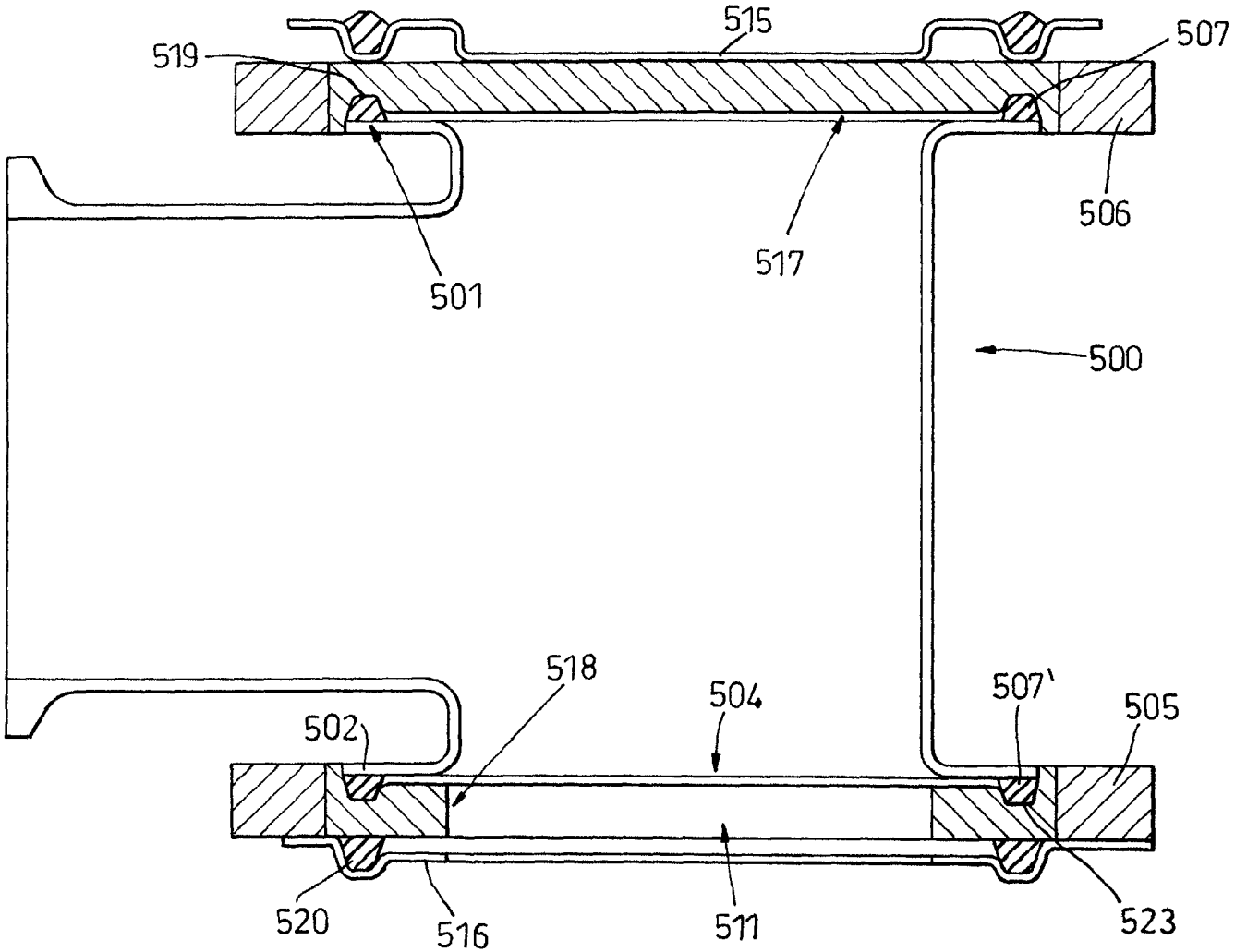
FIG. 5 shows a cross-section of a boss according to the first embodiment connected to a heat exchanger in a further arrangement.

Alternatively where the unpierced port of the heat transfer plate (515) needs supporting but the plate (506) of the connecting grid is manufactured with an aperture, an arrangement as shown in FIG. 5 can be used. In this arrangement a blanking disc (517) is placed in the aperture of the plate (506) between the unpierced port of the heat transfer plate (515) and the flanged surface (501) of the boss (500) for supporting the unpierced port of the heat transfer plate (515). The blanking disc (517) is manufactured with an annular groove (519) to accommodate the annular seal (507) on the flange (502).

Also shown in FIG. 4 is a boss (400) having opening (404) left open to be in fluid communication with the heat transfer plate. The plate (405) of the connecting grid is machined with an aperture (411) of a diameter to suit the diameter of the port in the heat transfer plate and the diameter of the opening (404) such that the fluid enters/exits the port smoothly.

Figure 6:
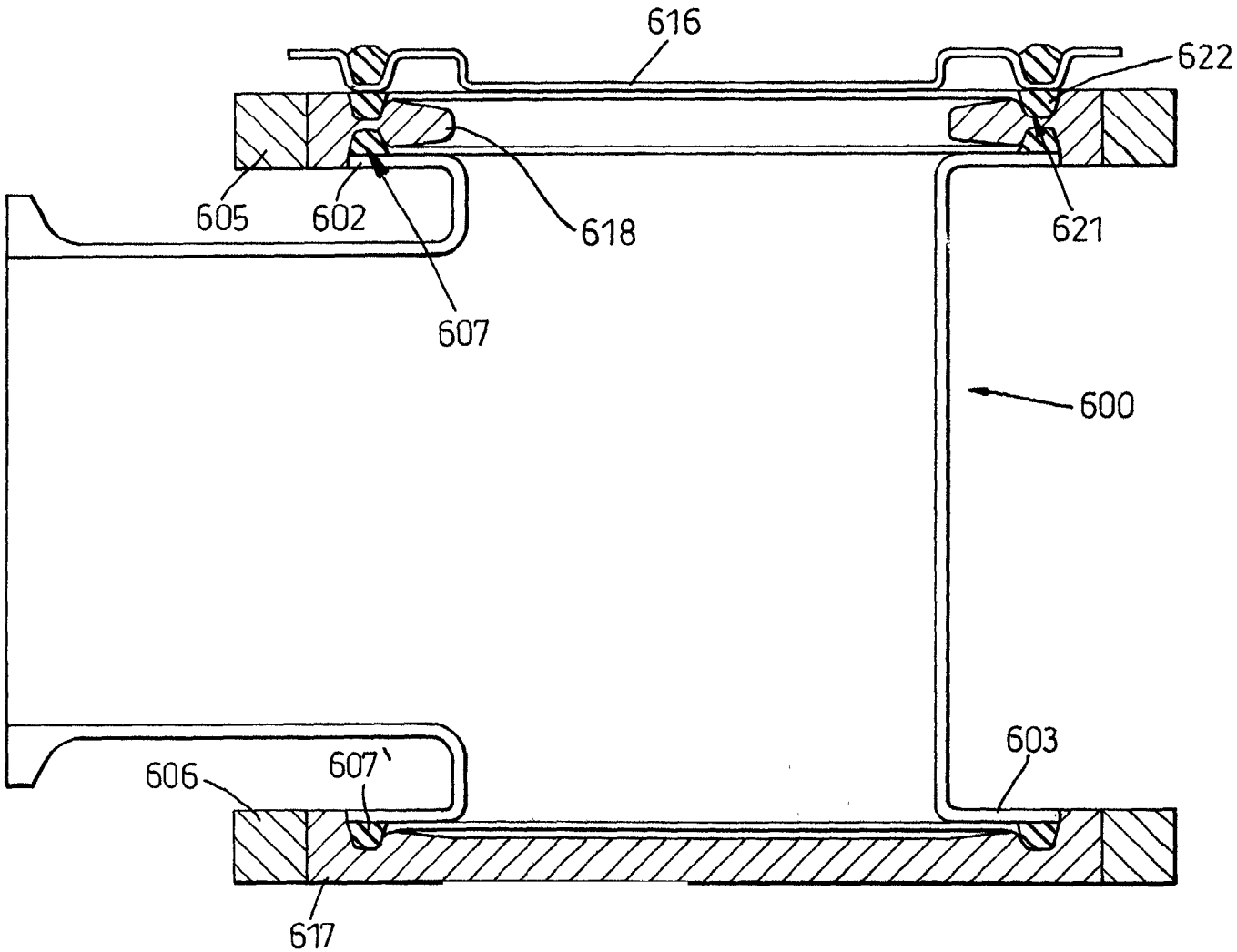
FIG. 6 shows a cross-section of a boss according to the first embodiment connected to a heat exchanger in yet another arrangement.

Alternatively, where an aperture (511) of a larger diameter than the opening (504) is provided in the plate (505) of the connecting grid, as shown in FIG. 5, a separate annular structural ring (518) is provided in the aperture (511) between the flange (502) and heat transfer plate (516). The structural ring accommodates for the difference in diameters of the respective openings. Similarly to the blanking disc (517), the structural ring (518) is provided with a groove (523) for accepting the seal (507'). With reference to FIG. 6, if the adjacent heat transfer plate (516) does not offer a sealing gasket (520), a further groove (621) will be required on the outside of the structural ring (618) and/or possibly on the blanking disc (617) or grid plate (605,606) of the connecting grid to accept a seal (622). A seal (607,607') is still required between the flange (602,603) and the structural ring or blanking disc (617,618).

Figure 7:
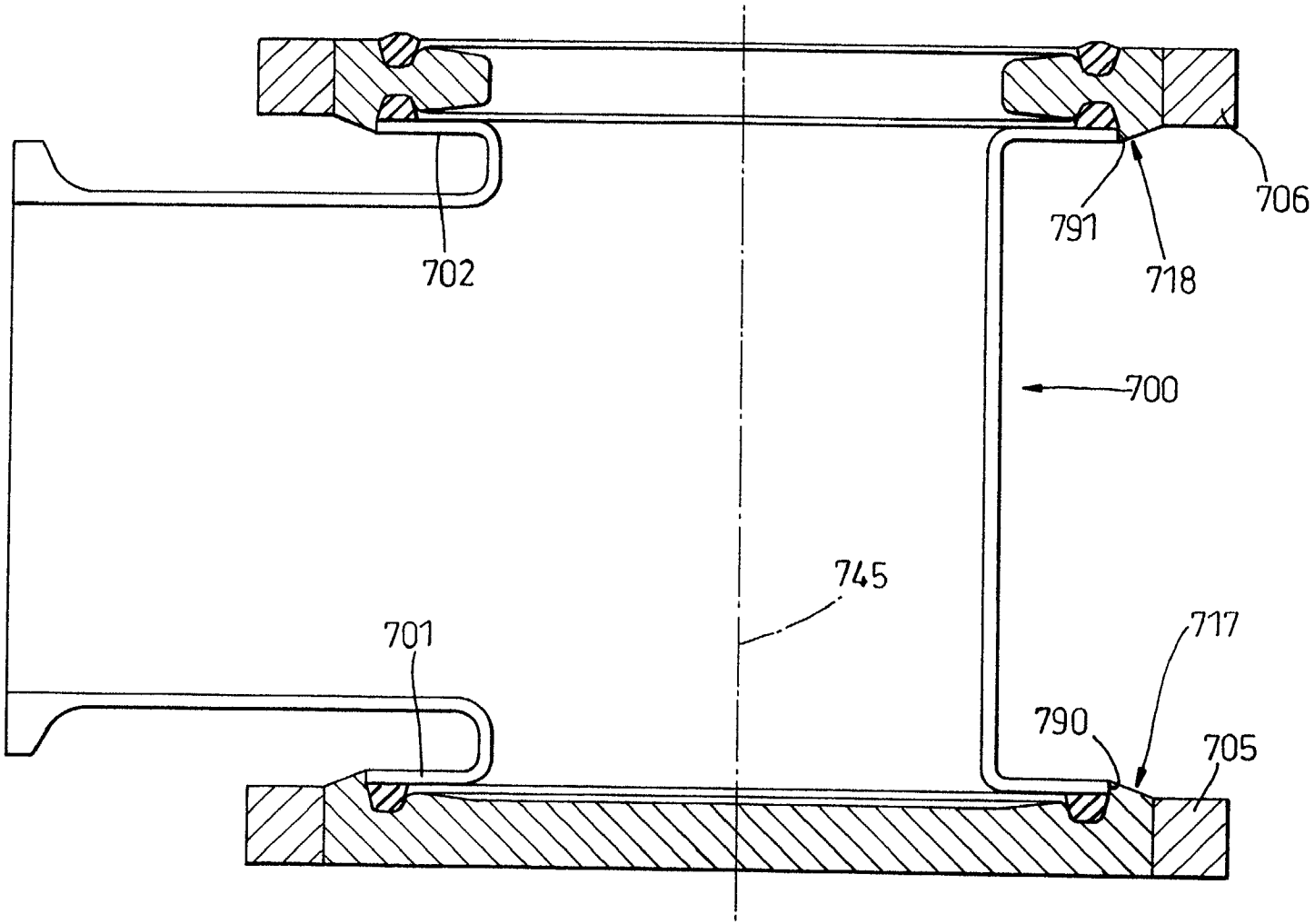
FIG. 7 shows a cross-section of a boss according to the first embodiment connected to a heat exchanger in a detachable arrangement.

Shown in FIG. 7 is an arrangement where the boss (700) is easily removable from the connecting grid. In this arrangement separate discs or structural rings (717 and 718) are provided of a thickness greater than the thickness of the plates (705 and 706) of the connecting grid. These discs or rings (717 and 718) can be knocked out and the boss (700) removed from between the plates (705 and 706) without removing the grid from the heat exchanger or removing the face plate from the connecting grid as the boss (700) has a width from flange to flange smaller than the inside separation of the plates (705, 706) of the connecting grid. In the embodiment shown in FIG. 7 the outside circumference of the structural ring or blanking disc (718, 717) is of the same width as the plate (706, 705) and the width of the structural ring or blanking disc (718, 717) increases diametrically towards an axis (745) of the structural ring (718) until the structural ring or blanking disc (718, 717) meets the end region (790, 791) of the flanges (701, 702).

Figure 8:
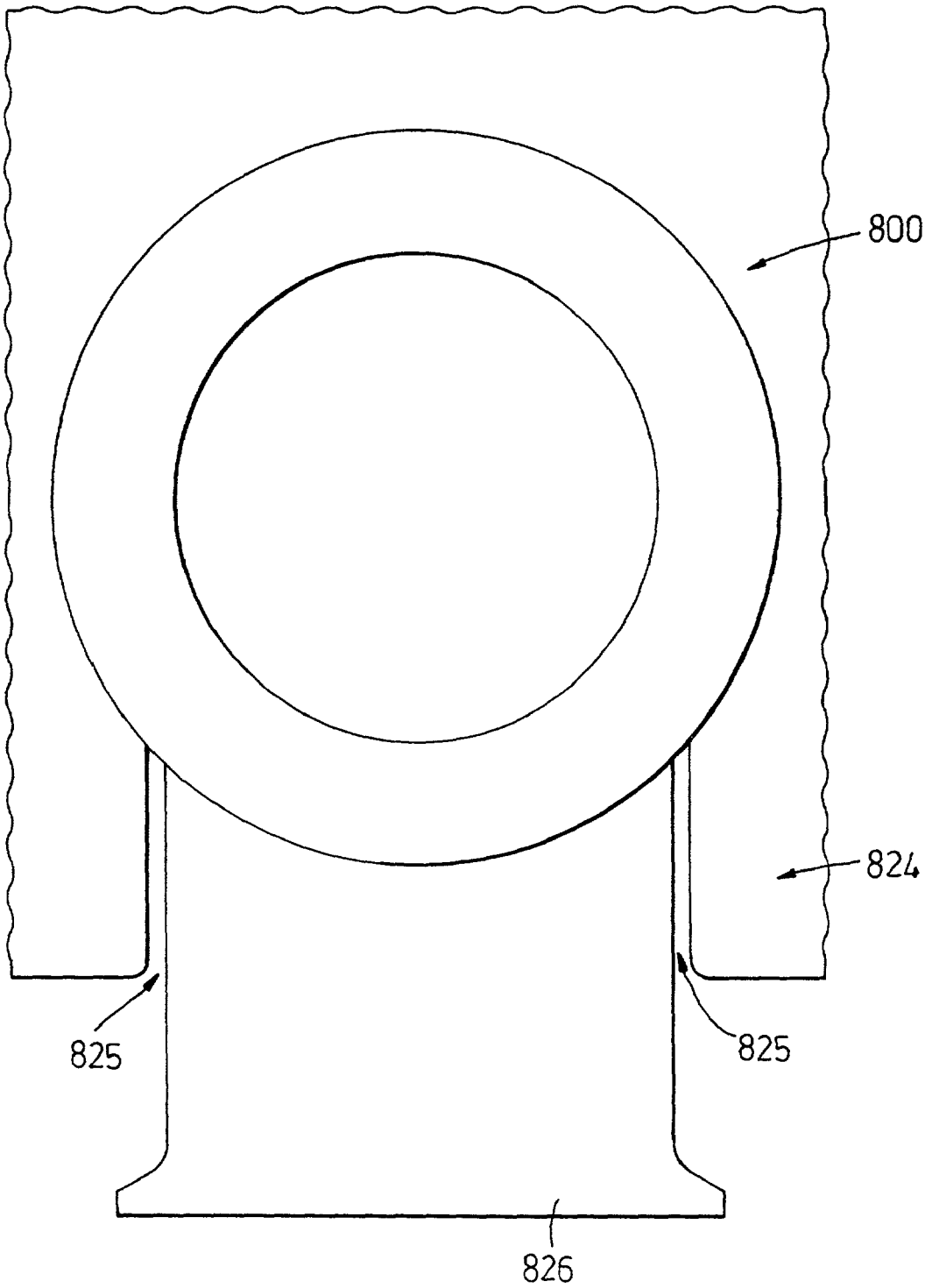
FIG. 8 shows a boss according to the first embodiment connected to a heat exchanger in another detachable arrangement.

In another detachable arrangement shown in FIG. 8 a boss (800) is wider than the inside separation of the plates of the connecting grid (824). The connecting grid (824) has a slot (825) extending from the edge of the grid (824) to the port of the adjacent heat transfer plate so that boss branch (826) will pass therethrough. Again this facilitates removal of the boss (800) from the connecting grid (824).

An advantage of using separate discs and structural rings, as described with reference to FIGS. 2–8, as opposed to machining into the plates of the connecting grid is that all the components in contact with a fluid may be manufactured from any suitable material without requiring the plates of the connecting grid to be made of the same material. In the case where titanium is used this represents a substantial cost reduction.

All the boss arrangements of the present invention facilitate assembly of the connecting grid and bosses and allows the use of bosses, ports in the heat transfer plates and apertures in plates in the connecting grid of non-co-operating dimensions e.g. different diameters, thicknesses etc. This increases flexibility of the apparatus.

In particular, a set of interchangeable inserts can be provided for a heat exchanger. The inserts comprise structural rings and blanking discs. The apertures of the structural rings may be of different sizes (diameters) to enable the connecting grid to be adapted for connection to any selected one of a number of bosses having openings of different diameters. Furthermore, the apertures of the structural rings may be at different positions to enable the connecting grid to accommodate arrangements where the opening of the boss is offset to the aperture in the connecting grid. Such eccentric bosses are described later herein with reference to FIG. 17 and FIG. 18 of the drawings. An advantage of providing a set of inserts with a heat exchanger is that bosses used with the connecting grid can be easily interchanged without machining the connecting grid or manufacturing new bosses.

Figure 9:
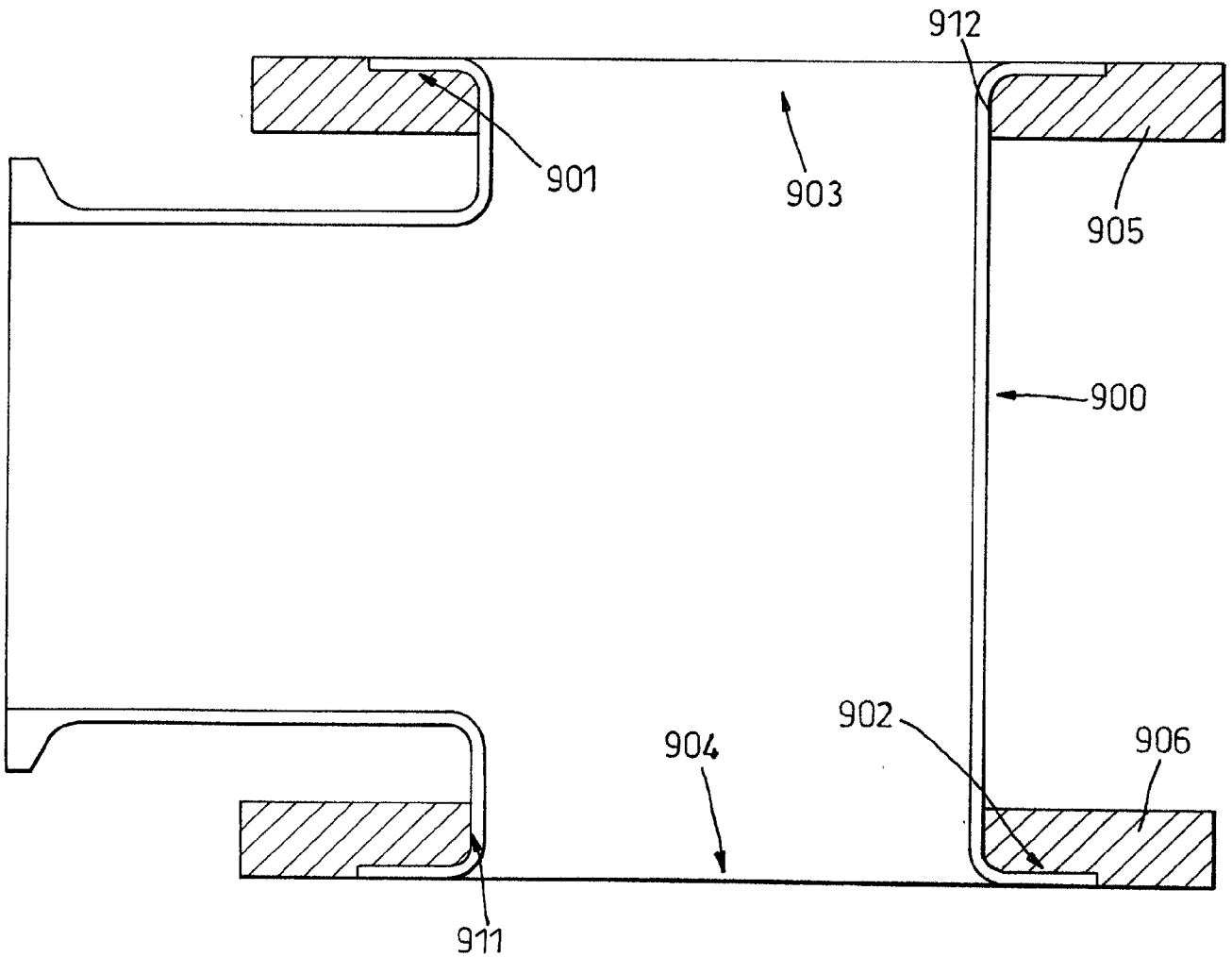
FIG. 9 shows a cross-section of a second embodiment of a boss according to the invention.

Shown in FIG. 9 is a boss (900) manufactured according to a second embodiment. The flanged ends (901 and 902) are provided in the opening (903 and 904) by passing the ends of a thin gauge tee (or tube, bend etc) through apertures (911, 912) in the plates (905, 906) of the connecting grid and pressing the ends of the thin gauge tee (or tube, bend etc) in place on the connecting grid such that the flanges (901 and 902) are pressed on the outside of the plates (905 and 906) of the connecting grid. During the pressing of the ends of the thin gauge tube the boss is temporarily clamped in position.

Figure 10:
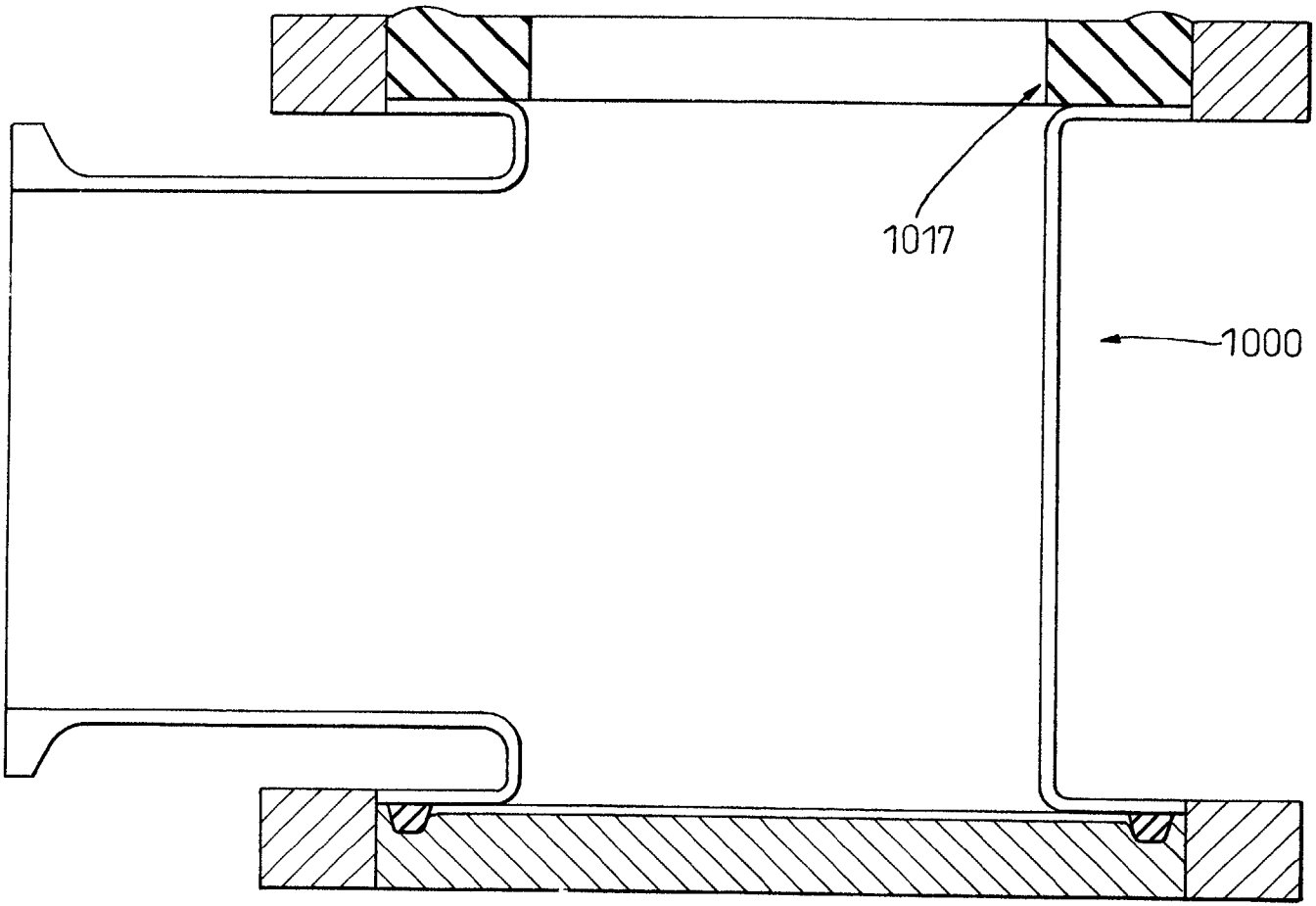
FIG. 10 shows a cross-section and boss according to a third embodiment of the invention.

Shown in FIG. 10 is a boss (1000) according to a third embodiment of the invention. In this embodiment the seal and structural ring are replaced by a single elastomeric seal ring (1017) strong enough not to require any additional support i.e. support grooves. This is advantageous as it reduces the number of parts of the boss and the manufacturing step of forming grooves in the structural rings is no longer required.

Figure 11:
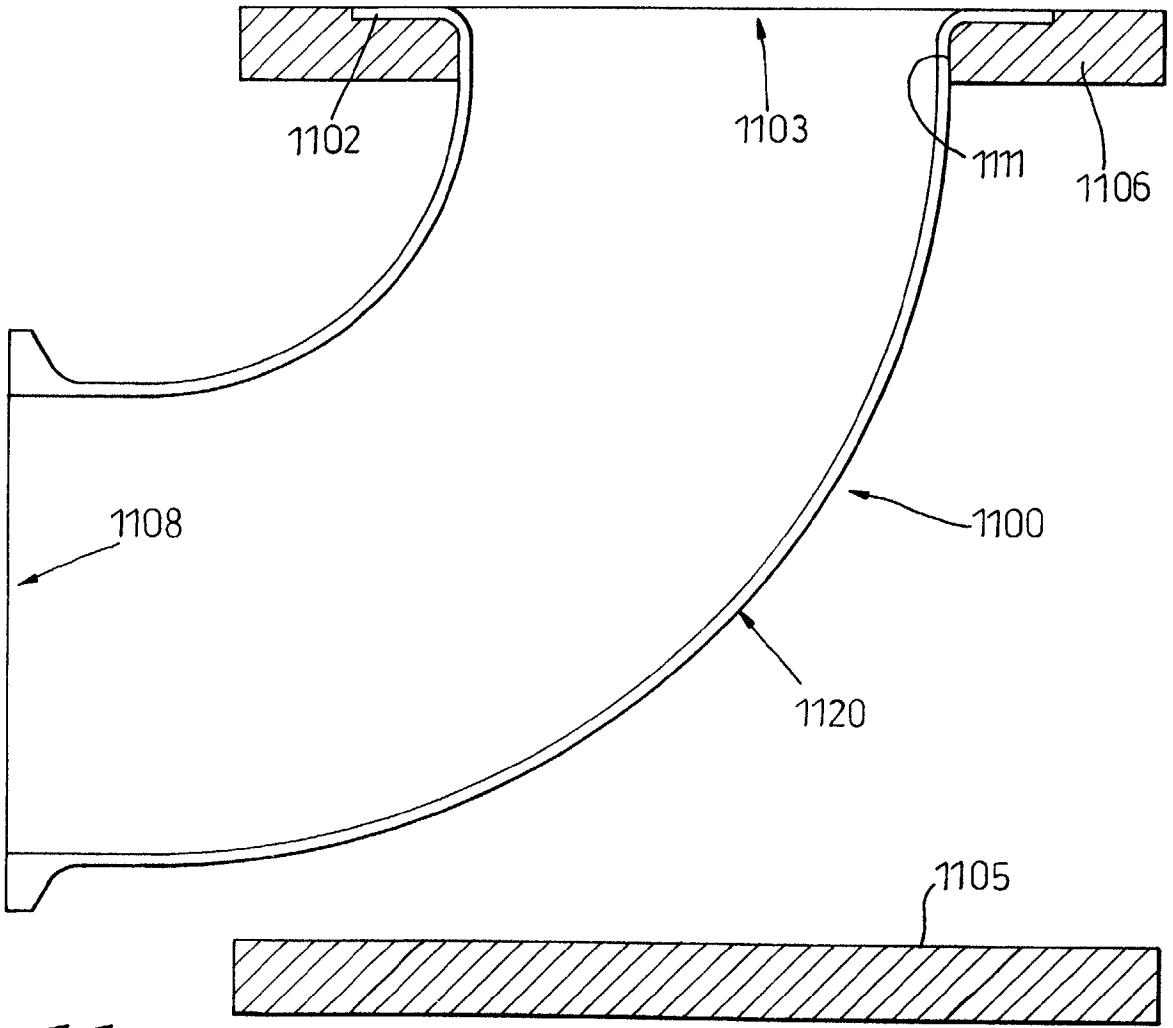
FIG. 11 shows a cross-section of a boss according to a fourth embodiment of the invention.

Shown in FIG. 11 is a fourth embodiment of the invention. A boss (1100) has an opening (1103) extending through an aperture (1111) in a plate (1106) of the connecting grid. The boss (1100) is manufactured according to the method of the second embodiment from a thin gauge tube with a bend (elbow) (1120). The boss has a single bend (1120) leading to an external opening (1108) with a fitting for use by the user. The plates (1106, 1105) of the connecting grid are separated sufficiently to accommodate the unmodified bend (1120). Therefore, the flange (1102) is pressed over the outside of the plate (1106) while the boss (1100) is clamped to the connecting grid, however it will be understood that the flange (1102) may be formed by the method as described with reference to FIG. 2 of the drawings and the boss (1100) separately supported.

Figure 12:
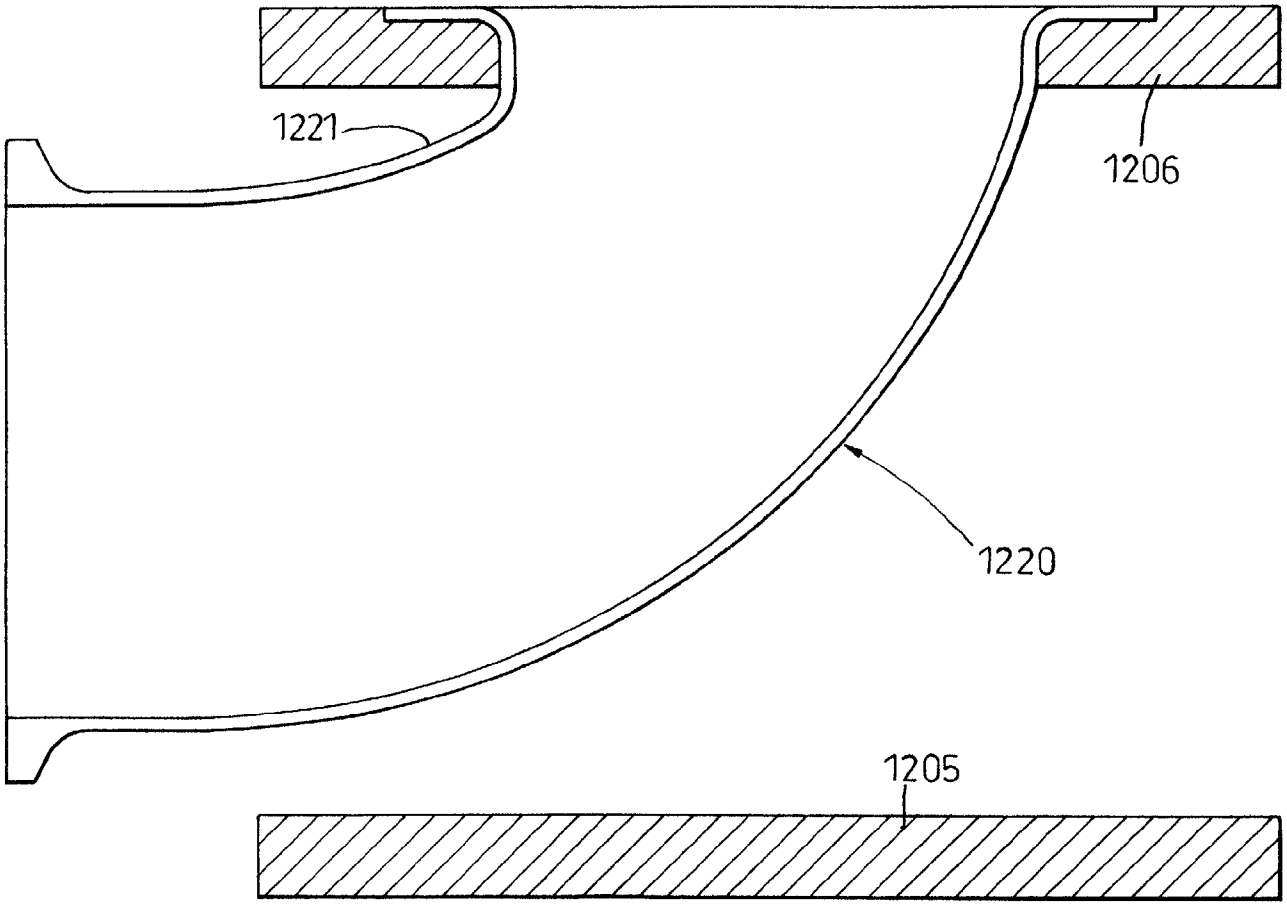
FIG. 12 shows a cross-section of a boss according to the fourth embodiment having a modified bend.

FIG. 12 shows a modification of this embodiment wherein the bend (1220) of the boss (1200) is modified with a pressing or fabrication operation so that the plates (1205, 1206) can be closer together.

The bend (1220) is kinked so as to have an inside bend (1221) having a radius of curvature that changes along the tubes length. It is desirable to minimise the space taken up by the connecting grid so as to allow the most number of heat transfer plates to fit within any single size of heat exchanger frame.

Figure 13:
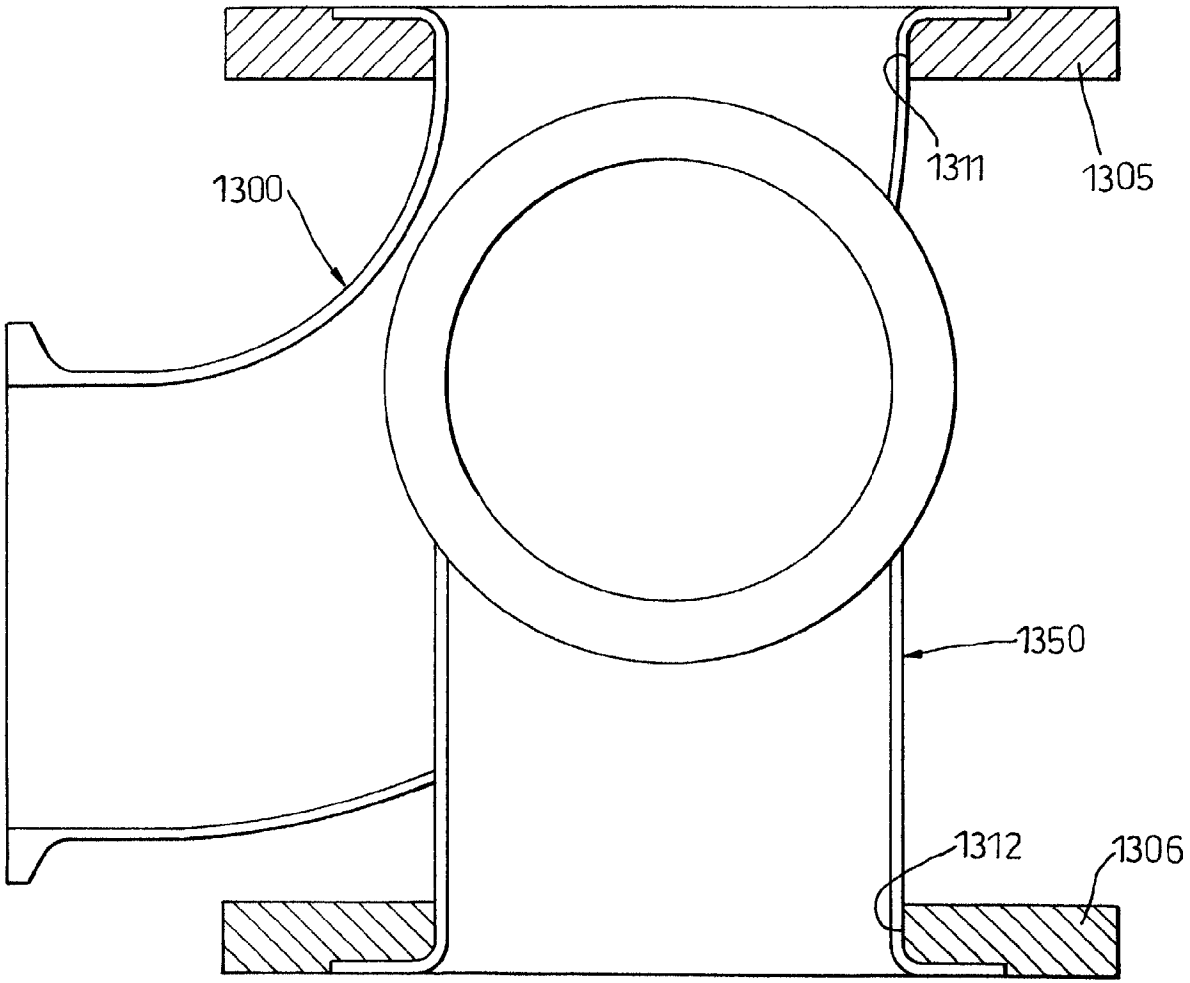
FIG. 13 shows a cross-section of a boss according to a fifth embodiment of the invention.

A fifth embodiment of the invention is shown in FIG. 13. In this arrangement, both the apertures (1312, 1311) opposite each other at the end of each section of the plate pack are to be used to pass fluid to external pipework without intermixing the fluids. Two bosses (1300, 1350) having a single bend are employed, one oriented horizontally and the other vertically (upwards or downwards). The bends may also be modified as described with reference to FIG. 12 to reduce the space between the plates (1305, 1306) of the connecting grid. The bends are modified by a pressing or fabrication process. The modified bend allows the bosses (1300, 1350) to sit more closely together.

Figure 14:
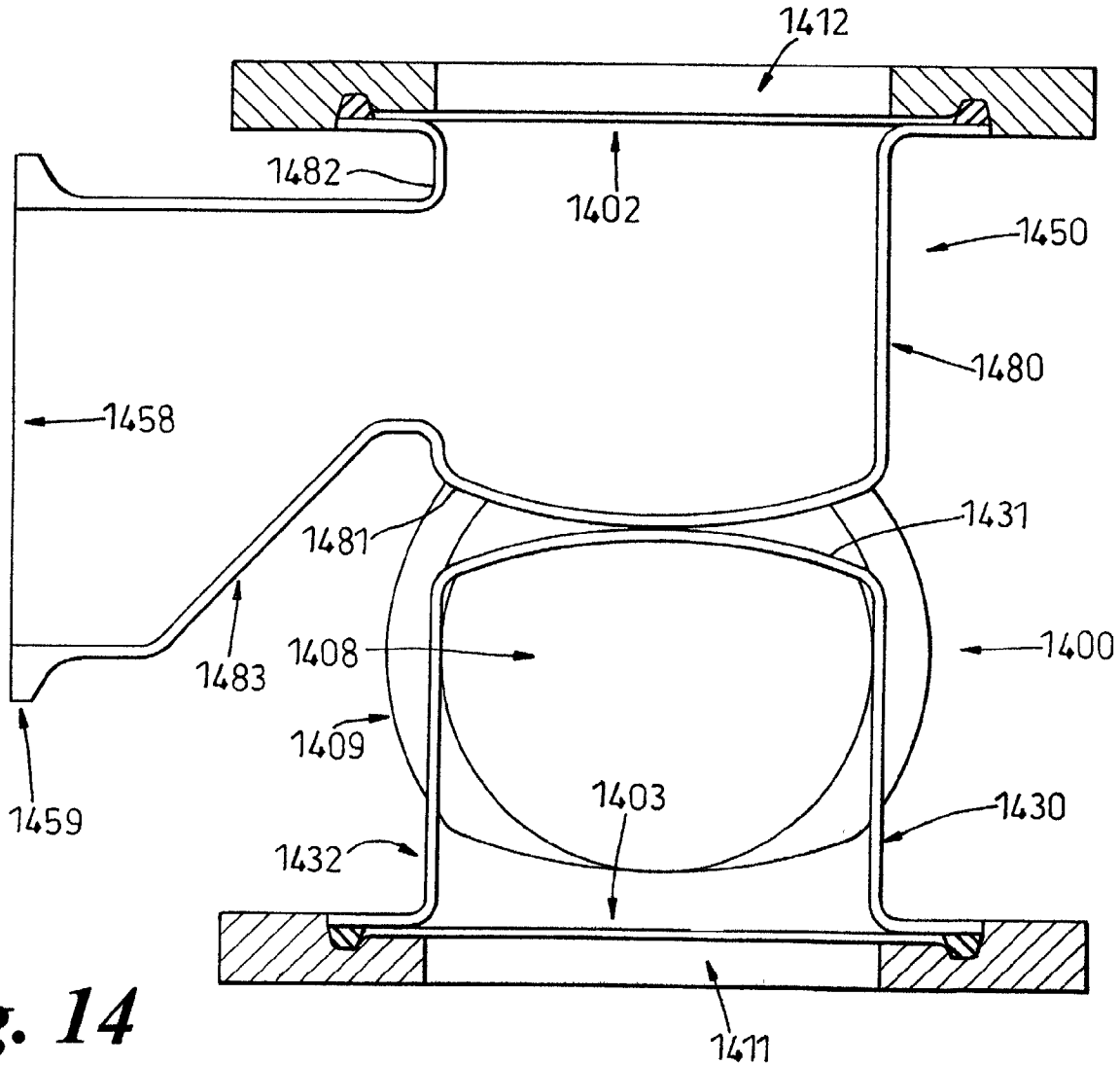
FIG. 14 shows a cross-section of a boss according to the fifth embodiment of the invention having a "top hat" design.
Figure 15:
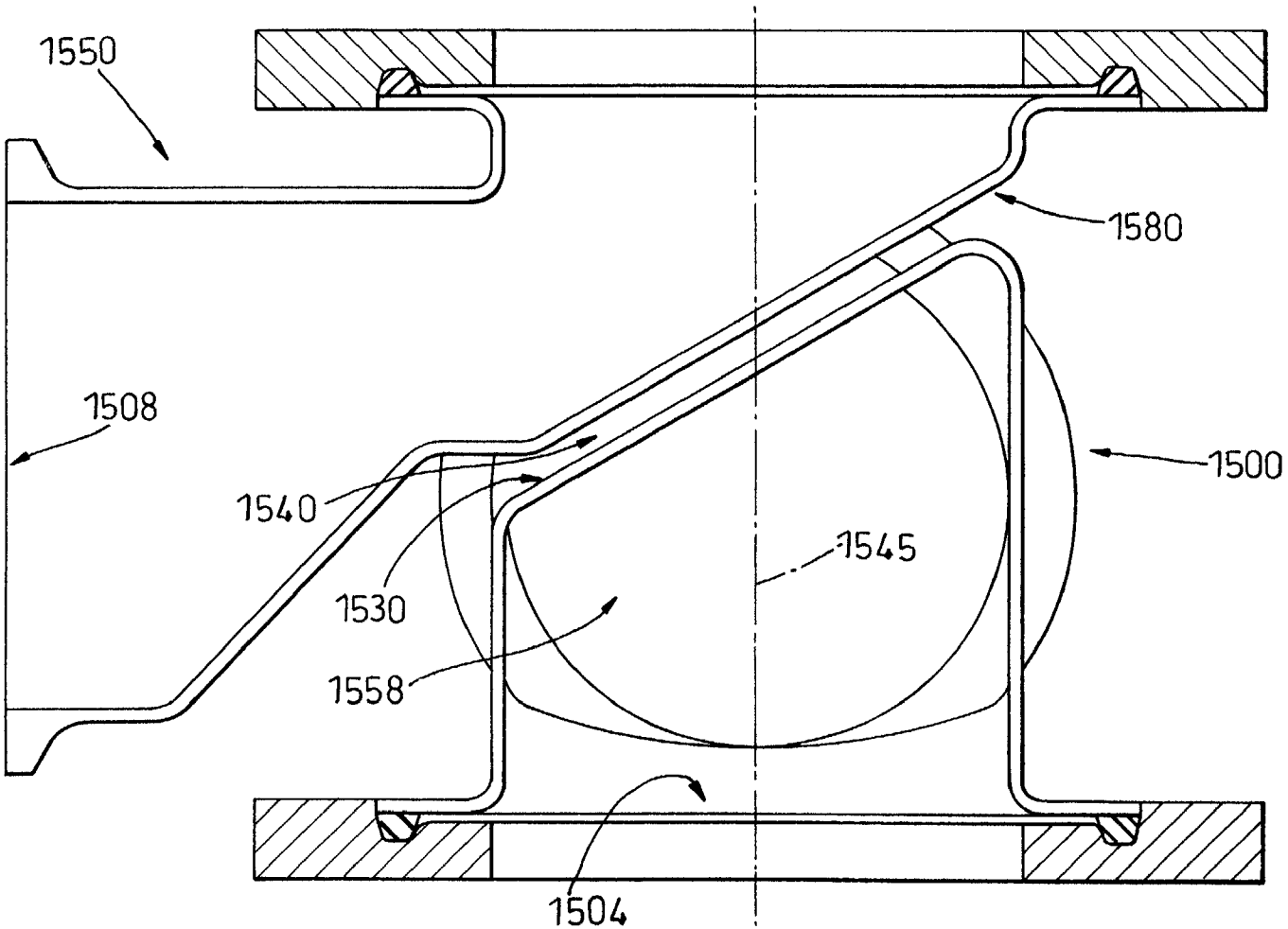
FIG. 15 shows a cross-section of a boss according to the fifth embodiment of the invention having a scarfed "top hat" design.

Other arrangements for accommodating two bosses with custom pressings in a connecting grid are shown in FIG. 14 and FIG. 15. FIG. 14 shows a "top hat" design where the bosses (1400, 1450) are pressed to have body portions (1430, 1480) defining substantially cylindrical chambers. The cylindrical chambers have rounded corners and closed tops (1431, 1481) at one end and openings (1403, 1404) of the bosses (1400, 1450) at the other end. Frusto-conical shaped channels (1433, 1483) in the 'sides' (1432, 1482) of the 'top hat' lead to external openings (1408, 1458) having apertures of a size to accommodate a branch with a fitting (1409, 1459). The two 'top hats' (1430, 1480) sit back to back almost abutting each other and are in fluid communication with the apertures (1411, 1412) in the plates (1405, 1406). Such an arrangement allows the bosses to sit more closely together.

FIG. 15 shows a pair of bosses (1500, 1550) with the 'top hat' design having scarfed (chamfered) tops (1530, 1580). The boss (1500, 1550) has a top (1530, 1580) slanting diametrically across the cylindrical chamber of the 'top hat'. A gap (1540) between the two bosses (1500, 1550) is fixed by some holding means, for example a separation disc of sufficient thickness with the optional addition of an 'O' ring for sanitary purposes. Alternatively, the tops may abut each other without a gap.

Figure 16:
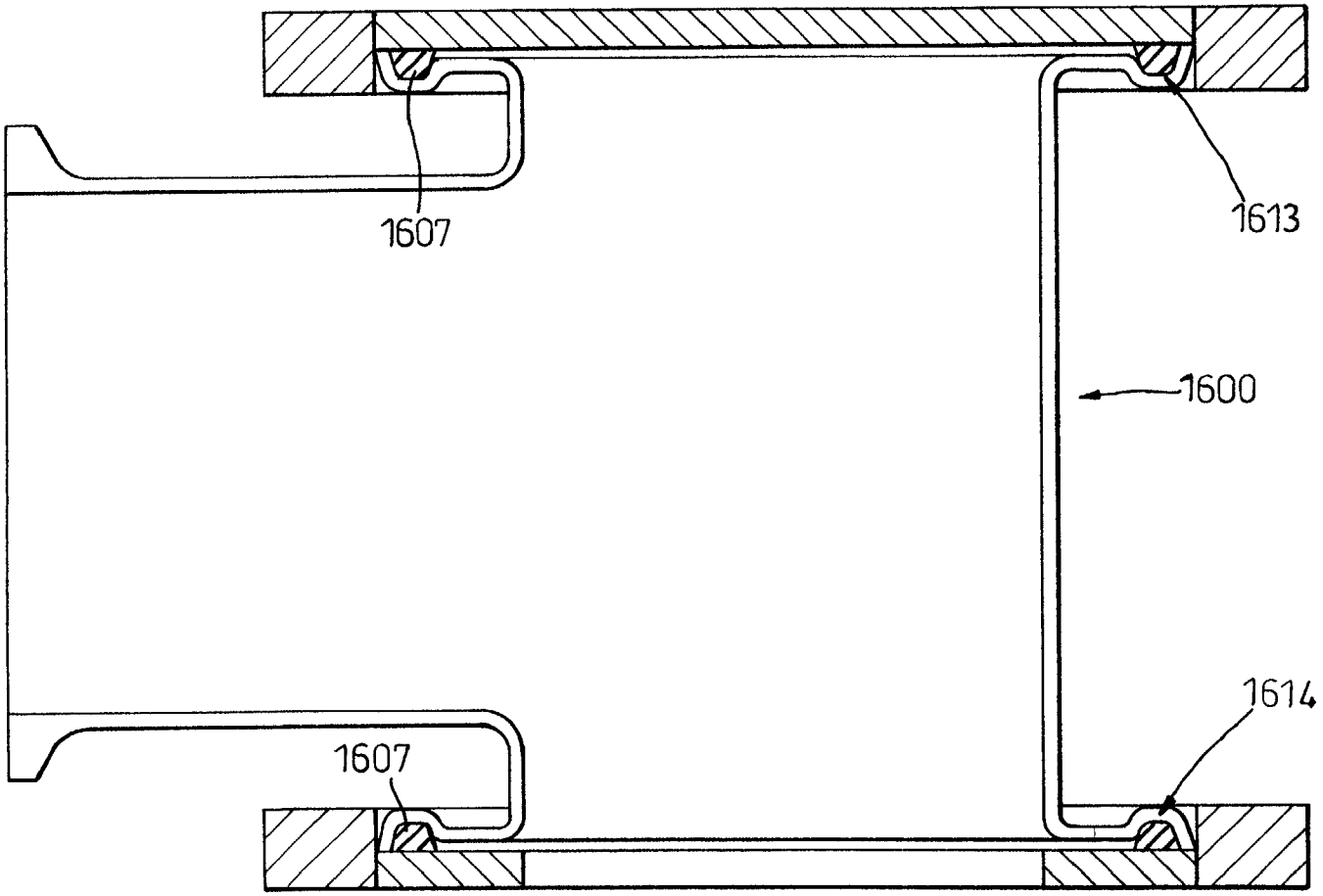
FIG. 16 shows a cross-section of a boss according to a sixth embodiment of the invention having pressed grooves.

Shown in FIG. 16 is a boss (1600) according to a sixth embodiment of the present invention wherein grooves (1613,1614) are pressed in the flanges (1601, 1602) of the boss (1600). The grooves (1613,1614) accommodate the seals (1607,1607').

Figure 17:
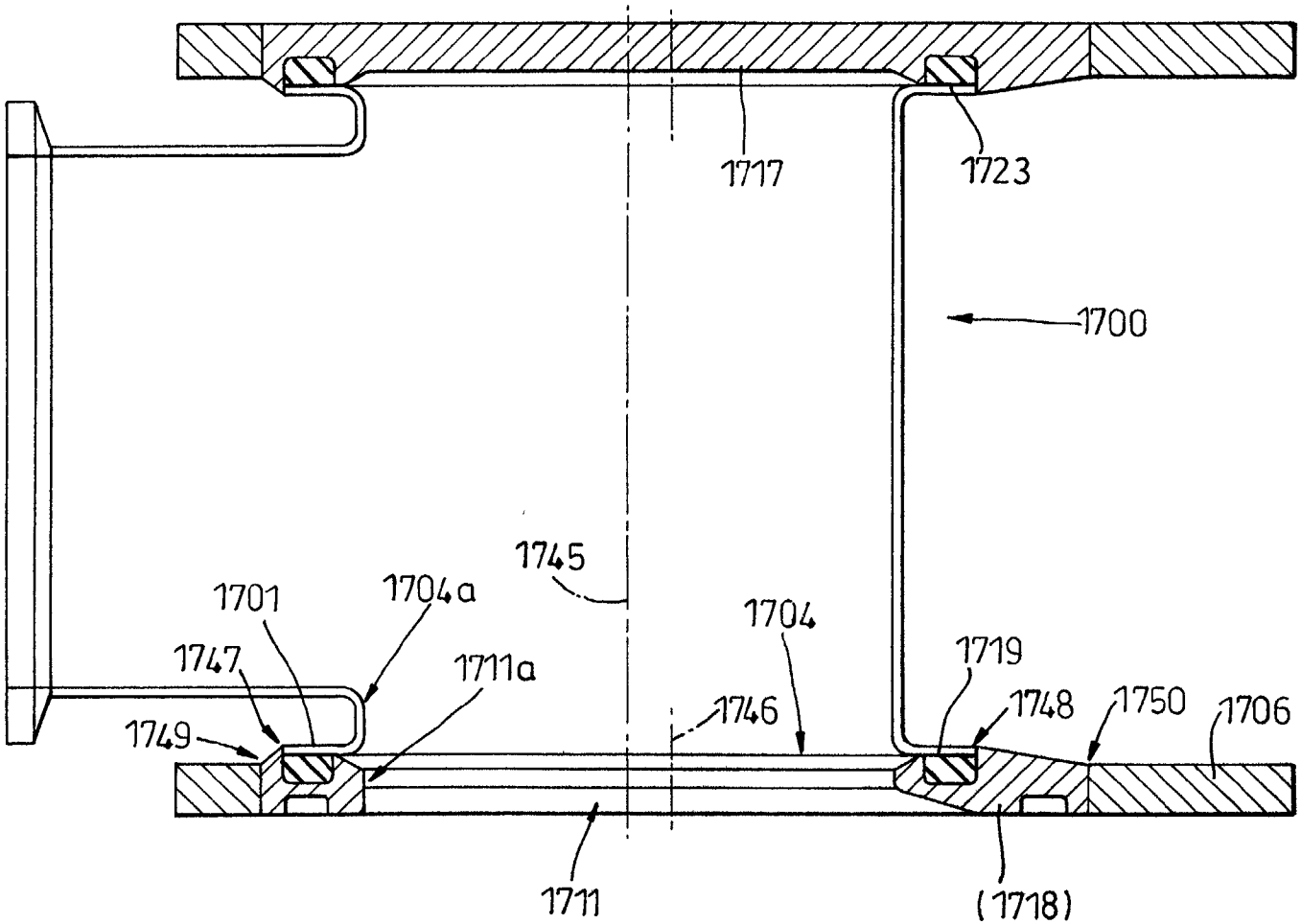
FIG. 17 shows a cross-section of an eccentric boss according to a seventh embodiment of the invention.
Figure 18:
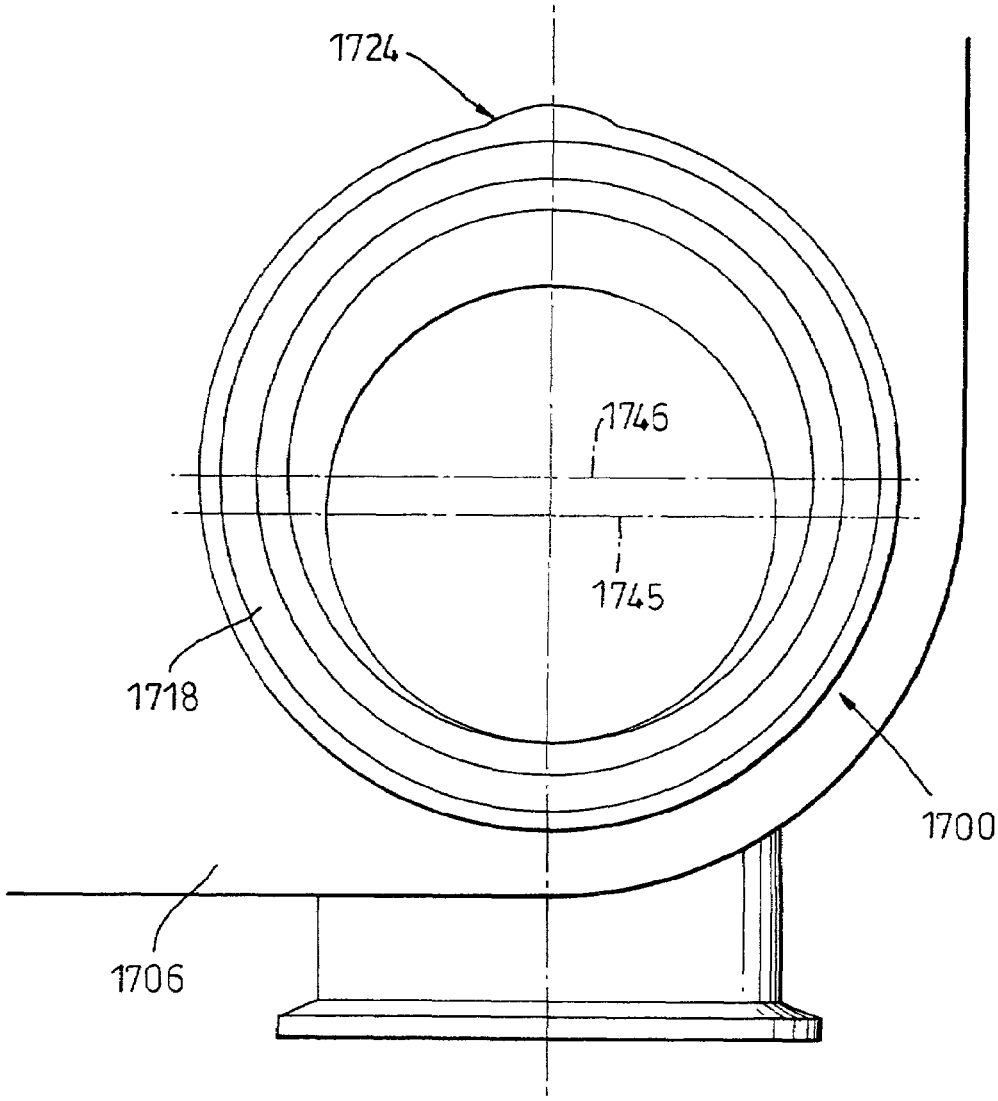
FIG. 18 shows a front on view of the eccentric boss according to the seventh embodiment of the invention.
Figure 19:
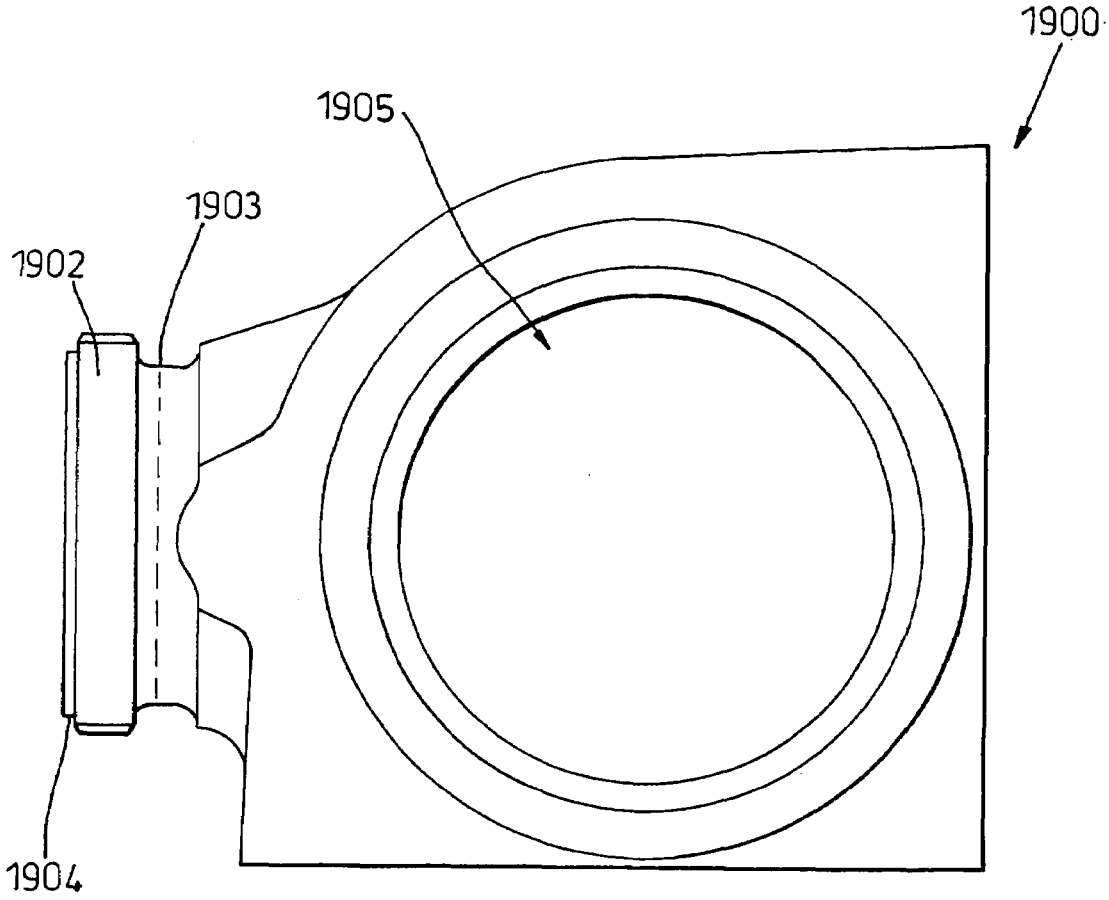
PRIOR ART Fig. 19
FIG. 19 shows a known boss made by sand or investment casting.

In some cases, the port in the heat transfer plate is of a diameter not designed for available standard tube, tee or bend diameters. However, it is still possible to utilise a standard tube, tee or bend of a diameter slightly smaller or larger than the port diameter with the use of an eccentrically machined plate, disc or structural ring. Such eccentric bosses are shown in FIG. 17 and FIG. 18.

The structural ring (1718) is manufactured to have a substantially circular outer circumference centred around axis (1746) but a substantially circular inner circumference centred around axis (1745). Therefore, the inner circumference of the structural ring (1718) aligns with the opening (1704) of the boss (1700) and the outer circumference aligns with the aperture (1711) of the plate (1706) of the connector grid.

The blanking disc (1717) is manufactured to be of substantially circular shape of the same diameter as the aperture (1711) in the plate (1706). Both the annular grooves (1719, 1723) in the blanking disc (1717) and structural ring (1718) are machined to have a centre in line with the axis (1745).

Eccentric bosses located at the bottom of the heat exchanger should be arranged such that an inside surface (1704*a*) of the opening (1704) of the boss (1700) that is directly below the axis (1745) of the opening (1704) and parallel with the axis (1745) is aligned with an inside surface (1711*a*) of the inside circumference of the port/structural ring (1718) directly below the axis (1746) of the port/structural ring (1718) i.e. the lowest inside surface of the opening (1704) is aligned with the lowest inside surface of the structural ring/port. This is for drainage purposes.

For eccentric bosses located at the top of the heat exchanger the inside surfaces of the opening (1704) and structural ring (1718) should be aligned directly above their respective radial axis (1745, 1746). This is for venting purposes.

To ensure that an eccentric disc or ring is correctly oriented during assembly of the boss/connecting grid, a small lobe or other keying mechanism (1724, FIG. 18) is provided on each ring or disc to complement an indentation formed at each port in the plate (1706) of the connecting grid. In an alternative arrangement the keying mechanism is provided in the plate and the indentation in the disc or ring. In a further alternative arrangement a mark is provided on the ring/disc and the plate (1706) which assists visual positioning of the ring/disc during assembly.

It will be understood that the invention is not limited to the above described embodiments but includes modifications and alterations that would be envisaged by a person skilled in the art and are within the scope of the appended claims. For example, a fourth opening could be provided, the opening having a fitting for connection to the user's pipework.

We claim:

1. A heat exchanger comprising a plurality of heat transfer plates stacked together such that a plurality of fluid channels are provided therebetween, at least one connecting grid comprising a pair of connecting grid plates separating the plurality of heat transfer plates into groups of heat transfer plates, and at least one fluid connector extending between the pair of connecting grid plates, the fluid connector comprising a tubular body having an outwardly directed flange formed integrally from a wall of the tubular body to sealingly connect the tubular body to a fluid channel between a first group of heat transfer plates on one side of the connecting grid via an opening in one of the connecting grid plates, wherein the opening is provided in a structural ring received in an aperture in a first connecting grid plate of the pair of connecting grid plates.

2. A heat exchanger as claimed in claim 1 wherein, the flange is produced integrally with the tubular body by deforming an end portion of the tubular body.

3. A heat exchanger as claimed in claim 1 wherein, the flange provides a fluid tight connection with a plate of the connecting grid.

4. A heat exchanger as claimed in claim 1 wherein, the structural ring permits the fluid connector to be detached without disassembling the connecting grid.

5. A heat exchanger according to claim 1 wherein, a set of interchangeable structural rings having different sizes of openings are provided for selective fitment in the aperture for connecting different sizes of fluid connectors.

6. A heat exchanger as claimed in claim 1 wherein, the structural ring provides an opening coaxial with the aperture in the first connecting grid plate.

7. A heat exchanger as claimed in claim 1 wherein, the structural ring provides an opening eccentric to the aperture in the first connecting grid plate.

8. A heat exchanger as claimed in claim 7 wherein, means is provided to assist rotational alignment of the structural ring during assembly.

9. A heat exchanger as claimed in claim 8 wherein, the alignment means comprises co-operating formations.

10. A heat exchanger as claimed in claim 8 wherein, the alignment means comprises marks to assist visual alignment of the structural ring.

11. A heat exchanger as claimed in claim 1 wherein, a seal provides a fluid tight connection between the flange and the structural ring.

12. A heat exchanger as claimed in claim 11 wherein, the seal comprises an annular sealing ring received in a groove in one of the flange and structural ring.

13. A heat exchanger as claimed in claim 1 wherein, the structural ring is made of elastomeric material providing a fluid tight connection to the flange.

14. A heat exchanger as claimed in claim 1 wherein, the fluid connector provides an inlet/outlet connection externally of the heat exchanger.

15. A heat exchanger as claimed in claim 1 wherein, the fluid connector comprises a further outwardly directed flange formed integrally from a wall of the tubular body to sealingly connect the tubular body to a fluid channel between a second group of heat transfer plates on the other side of the connecting grid via an opening in the other of the connecting grid plates.

16. A heat exchanger as claimed in claim 15 wherein, a blanking disc is provided for closing the opening in one of the connecting grid plates.

17. A heat exchanger as claimed in claim 1 wherein, the tubular body is formed from thin gauge tube or pipe having a nominal diameter to wall thickness ratio within the range of 20 to 70.

18. A heat exchanger comprising a plurality of heat transfer plates stacked together such that a plurality of fluid channels are provided therebetween, at least one connecting grid separating said plurality of heat transfer plates into groups of heat transfer plates, and at least one fluid connector comprising a tubular body having an outwardly directed flange formed integrally from a wall of said tubular body to sealingly connect said tubular body to a fluid channel between a first said group of heat transfer plates on one side of said connecting grid via an opening in said connecting grid, wherein said opening is formed in a detachable structural ring received in an aperture in said connecting grid, and a set of interchangeable structural rings is provided for selective fitment in said aperture for connecting the connecting grid to different sizes of fluid connectors.

19. A heat exchanger comprising a plurality of heat transfer plates stacked together such that a plurality of fluid channels are provided therebetween, at least one connecting grid comprising a pair of plates separating the plurality of heat transfer plates into groups of heat transfer plates, and at least one fluid connector extending between said pair of connecting grid plates, said fluid connector comprising a tubular body having an outwardly directed flange formed integrally from a wall of the tubular body to sealingly connect said tubular body to a fluid channel between a first said group of heat transfer plates on one side of said connecting grid via an opening in one of said connecting grid plates, wherein said opening is formed in a structural ring received in an aperture in said connecting grid, and an annular sealing ring is received in a groove in one of said flange and said structural ring to provide a fluid tight connection between said fluid connector and said connecting grid.

20. A heat exchanger comprising a plurality of heat transfer plates stacked together such that a plurality of fluid channels are provided therebetween, at least one connecting grid comprising a pair of plates separating the plurality of heat transfer plates into groups of heat transfer plates, and at least one fluid connector extending between said pair of connecting grid plates, said fluid connector comprising a tubular body having first and second outwardly directed flanges formed integrally from a wall of the tubular body, said first outwardly directed flange sealingly connecting said tubular body to a fluid channel between a first said group of heat transfer plates on one side of said connecting grid via an opening in one of said connecting grid plates, said second outwardly directed flange sealingly connecting said tubular body to a fluid channel between a second said group of heat transfer plates on the other side of said connecting grid via an opening in the other of said connecting grid plates, and a detachable blanking disc for selective fitment in one of said openings in said connecting grid plates to close the fluid connection to one of said first and second groups of heat transfer plates.

21. A heat exchanger comprising a plurality of heat transfer plates stacked together such that a plurality of fluid channels are provided therebetween, at least one connecting grid comprising a pair of connecting grid plates separating the plurality of heat transfer plates into groups of heat transfer plates, and at least one fluid connector extending between the pair of connecting grid plates, the fluid connector comprising a tubular body having a first outwardly directed flange formed integrally from a wall of the tubular body to sealingly connect the tubular body to a fluid channel between a first group of heat transfer plates on one side of the connecting grid via an opening in one of the connecting grid plates and a second outwardly directed flange formed integrally from a wall of the tubular body to sealingly connect the tubular body to a fluid channel between a second group of heat transfer plates on the other side of the connecting grid via an opening in the other of the connecting grid plates.

22. A heat exchanger as claimed in claim 21 wherein, a blanking disc is provided for closing the opening in one of the connecting grid plates.

* * * * *